US010881235B1

(12) United States Patent
Vasquez et al.

(10) Patent No.: US 10,881,235 B1
(45) Date of Patent: Jan. 5, 2021

(54) COMBINATION OUTDOOR FURNITURE AND LOCKING PACKAGE STORAGE

(71) Applicants: Gary Vasquez, Whittier, CA (US); Laurie Vasquez, Whittier, CA (US)

(72) Inventors: Gary Vasquez, Whittier, CA (US); Laurie Vasquez, Whittier, CA (US)

( * ) Notice: Subject to any disclaimer, the term of this patent is extended or adjusted under 35 U.S.C. 154(b) by 0 days.

(21) Appl. No.: 16/785,150

(22) Filed: Feb. 7, 2020

(51) Int. Cl.

| | |
|---|---|
| ***A47G 29/14*** | (2006.01) |
| ***A47G 29/20*** | (2006.01) |
| ***A47G 29/30*** | (2006.01) |
| ***A47C 7/62*** | (2006.01) |
| *E05B 67/06* | (2006.01) |
| *A47G 29/124* | (2006.01) |

(52) U.S. Cl.
CPC ..... *A47G 29/141* (2013.01); *A47C 7/628* (2018.08); *A47G 29/20* (2013.01); *A47G 29/30* (2013.01); *A47G 2029/1257* (2017.08); *E05B 67/06* (2013.01)

(58) Field of Classification Search
CPC ..... A47G 29/20; A47G 29/30; A47G 29/14; A47G 29/141; A47G 29/16; A47G 2029/1257; A47G 2029/144; A47G 2029/148; E05B 67/06; B65D 55/14; A47C 13/00; A47C 7/628; A47C 11/00
USPC ..... 232/44, 45, 38, 39, 19; 297/118; 70/63
See application file for complete search history.

(56) References Cited

U.S. PATENT DOCUMENTS

| | | | | |
|---|---|---|---|---|
| 10,039,401 | B1 * | 8/2018 | Romanucci | A47C 7/628 |
| 10,638,848 | B1 * | 5/2020 | Wesley | E05B 49/00 |
| 2001/0045449 | A1 * | 11/2001 | Shannon | G07C 9/21 232/19 |
| 2018/0070753 | A1 * | 3/2018 | Eveloff | G07C 9/00912 |
| 2018/0303265 | A1 * | 10/2018 | Hearne | A47G 29/1248 |
| 2018/0310714 | A1 * | 11/2018 | Becker | A47C 11/00 |
| 2019/0000255 | A1 * | 1/2019 | Dehner | A47G 29/20 |
| 2019/0239650 | A1 * | 8/2019 | Nelson | E05B 65/52 |
| 2019/0368259 | A1 * | 12/2019 | Wei | A47G 29/20 |
| 2019/0387910 | A1 * | 12/2019 | Stoich | G07C 9/33 |
| 2020/0121087 | A1 * | 4/2020 | Kilburn | A47C 11/00 |
| 2020/0121088 | A1 * | 4/2020 | Chasnis, II | A47G 29/124 |
| 2020/0163480 | A1 * | 5/2020 | Waisanen | E05F 15/60 |

* cited by examiner

*Primary Examiner* — William L Miller
(74) *Attorney, Agent, or Firm* — Averill & Green; Kenneth L. Green

(57) ABSTRACT

A secure package receptacle is a combination outdoor furniture and locking package storage. Outdoor furniture is often placed near a home entry and provides useful seating and does not draw attention to the locking package storing. A seat portion provides a locking storage area for bulky packages and a backrest portion provides a second locking storage area for flat packages. Each locking storage area is lockable using a common padlock, pushbutton lock lockable by a delivery driver and unlockable by a homeowner using a key, or any other lock unlockable by a homeowner. A base of the secure package receptacle includes space for solid or liquid weight to make it difficult to remove. Features are included to secure the secure package receptacle to a wall.

16 Claims, 3 Drawing Sheets

COMBINATION OUTDOOR FURNITURE AND LOCKING PACKAGE STORAGE

BACKGROUND OF THE INVENTION

The present invention relates to secure storage of packages delivered to residences, and in particular to outdoor furniture including lockable storage.

In recent years the theft of packages left at home entries has increased drastically. As on-line sales have increased, individuals follow delivery trucks and steal packages left at home entries. These entries are often visible from the street and allow easy theft.

BRIEF SUMMARY OF THE INVENTION

The present invention addresses the above and other needs by providing a secure package receptacle which is a combination outdoor furniture and locking package storage. Outdoor furniture is often placed near a home entry and provides useful seating and does not draw attention to the locking package storing. A seat portion provides a locking storage area for bulky packages and a backrest portion provides a second locking storage area for flat packages. Each locking storage area is lockable using a common padlock, pushbutton lock lockable by a delivery driver and unlockable by a homeowner using a key, or any other lock unlockable by a homeowner. A base of the secure package receptacle includes space for solid or liquid weight to make it difficult to remove. Features are included to secure the secure package receptacle to a wall.

In accordance with one aspect of the invention, there is provided a secure package receptacle including seat and backrest portions with lockable lids. The lids may be hinged at the rear and be lockable at the front to secure packages.

In accordance with another aspect of the invention, there is provided a secure package receptacle lockable by common padlocks. The padlock is left unlocked and is locked by delivery personnel securing the package in the secure package receptacle.

In accordance with another aspect of the invention, there is provided a secure package receptacle lockable by a built-in lock. The built-in lock is fixed to the secure package receptacle and lockable by delivery personnel securing the package in the secure package receptacle.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement, or typically within 10 percent of a stated value.

Figure 1B:
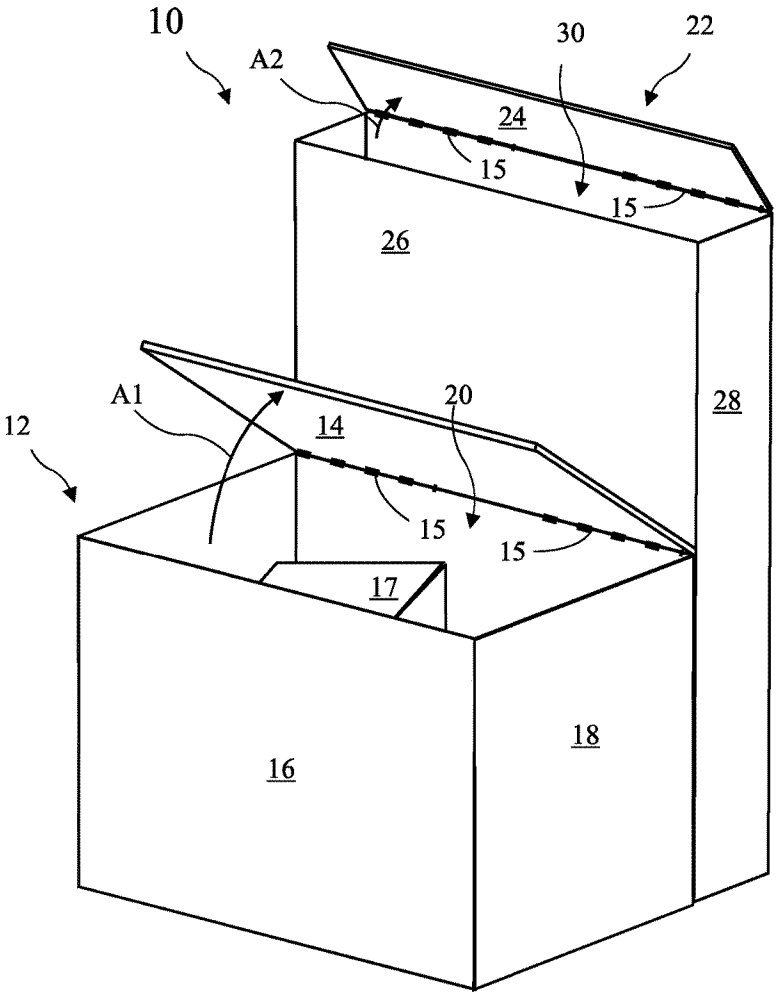
FIG. 1B shows the secure package receptacle according to the present invention with a seat portion and backrest portion open to receive packages.
Figure 1A:
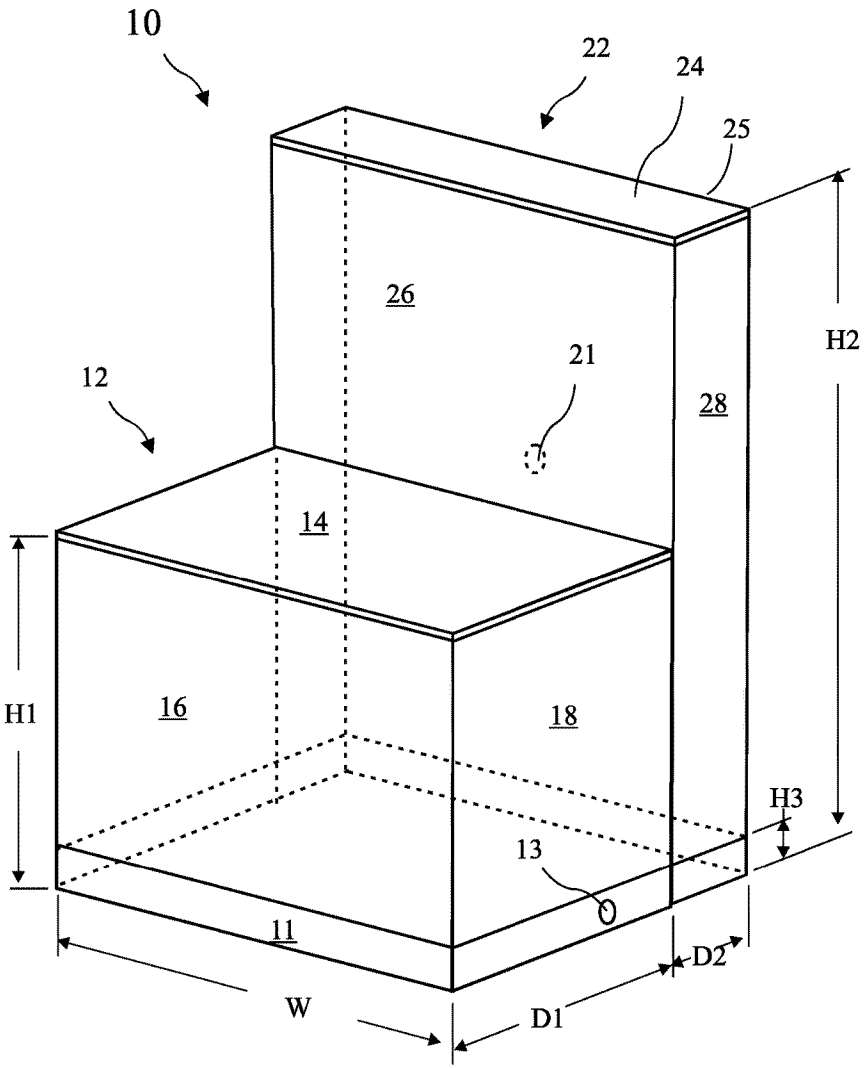
FIG. 1A shows a secure package receptacle according to the present invention.

A secure package receptacle 10 according to the present invention is shown in FIG. 1A and the secure package receptacle 10 with a seat portion 12 and backrest portion 22 open to receive packages 17 is shown in FIG. 1B. The seat portion 12 has sides 18, front 16, and a seat door 14. The seat door 14 is open along arc A1 and hinges 15 to show a seat interior 20. The backrest portion 22 has sides 28, front 26, and a backrest door 24. The backrest door 24 is open along arc A2 and the hinges 15 to show a backrest interior 30. The doors 14 and 24 may be opened by delivery personnel to securely store packages. A weighted base 11 at the bottom of the secure package receptacle 10 may contain solid or liquid weight and may include a plugged opening 13 for adding liquid, for example, water. A rear surface 25 may include an anchor passage 21 for attaching the secure package receptacle 10 to a wall.

The secure package receptacle 10 has a width W. The seat portion 12 has a height H1 and depth D1. The backrest portion 22 has height H2 and depth D2. The weighted base 11 has a height H3. The width W is preferably between 24 and 36 inches and more preferably about 30 inches, and most preferably, 30 inches. The height H1 is preferably between 18 and 24 inches and more preferably about 20 inches and most preferably 20 inches. The depth D1 is preferably between 15 and 29 inches and more preferably about 17 inches and most preferably 17 inches. The height H2 is preferably between 36 and 44 inches and more preferably about 40 inches and most preferably 40 inches. The depth D2 is preferably between 4 and 8 inches and more preferably about 6 inches and most preferably 16 inches. The height H3 is preferably between 4 and 8 inches and more preferably about 6 inches and most preferably 6 inches.

Figure 2A:
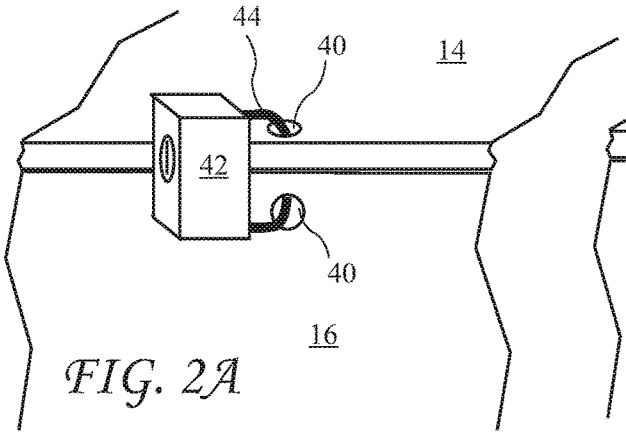
FIG. 2A shows a padlock for locking the secure package receptacle of a seat portion according to the present invention.
Figure 2B:
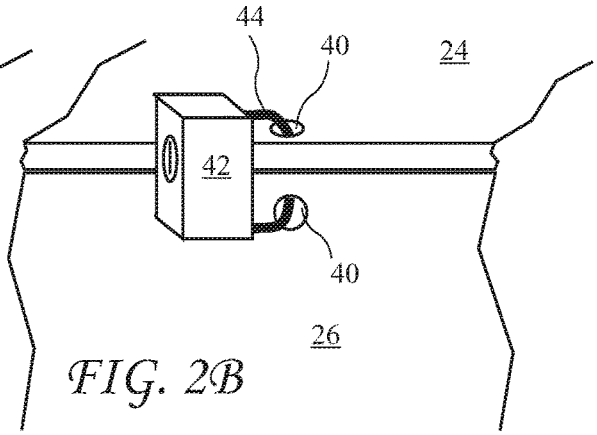
FIG. 2B shows a padlock for locking the secure package receptacle of the backrest portion according to the present invention.

A padlock 42 for locking the secure package receptacle 10 is shown in FIG. 2. A padlock shackle (or shank) 44 passes through passages 40 to secure the door 14 or 24. The padlock 42 may be left inside the interior 20 or 30, or with the shackle 44 passing through the passages 40, but not locked.

Figure 3A:
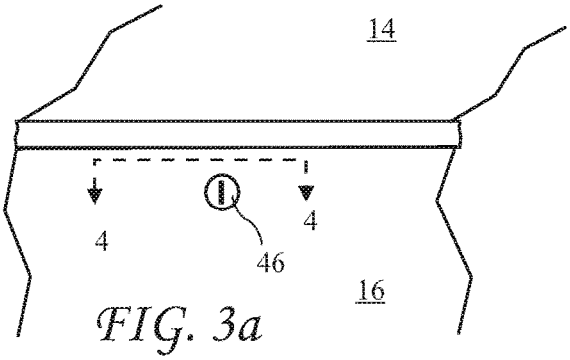
FIG. 3A shows a front view of a built-in manually lockable and key unlockable lock in a seat portion according to the present invention.
Figure 3B:
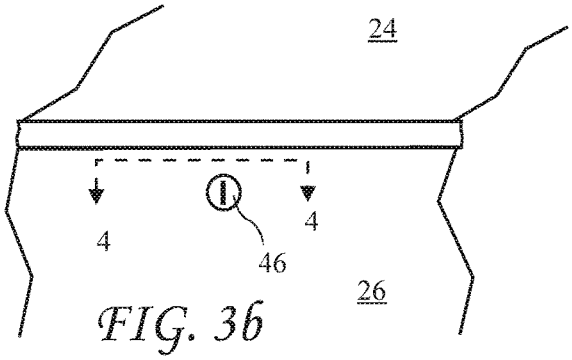
FIG. 3B shows a front view of a built-in manually lockable and key unlockable lock in the backrest portion according to the present invention.

A front view of a built-in manually lockable and key unlockable lock 60 (see FIGS. 5A-5F) is shown in FIG. 3. The lock 60 includes a manually engageable mechanism and a key 47 (see FIG. 4) actuated disengagement mechanism. The manually engageable mechanism may be engaged by delivery personnel after placing a package inside the secure package receptacle 10, and later disengaged using 47 key inserted through a lock face 46 to retrieve the package.

Figure 4:
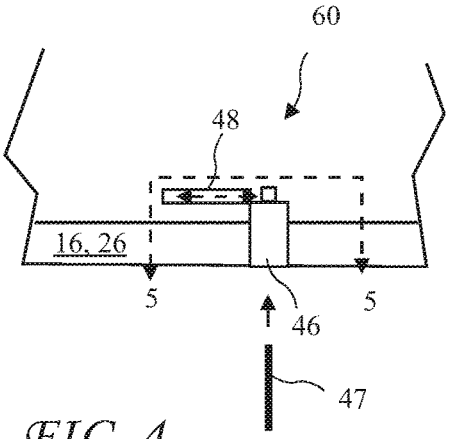
FIG. 4 shows a cross-sectional view of the built in manually lockable and key unlockable lock according to the present invention taken along line 4-4 of FIG. 3.
Figure 5A:
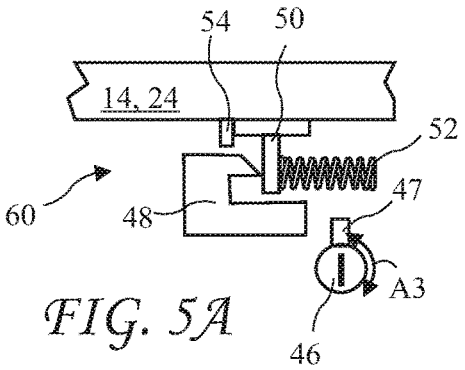
FIG. 5A shows a cross-sectional view of the built in manually lockable and key unlockable lock according to the present invention taken along line 5-5 of FIG. 4, unlocked with the door closed.

A cross-sectional view of the lock 60 taken along line 5-5 of FIG. 4, unlocked with the door 14 or 24 closed, is shown in FIG. 5A. A latch 48 is positioned to the left disengaged from a catch 50. The latch 48 slides right and left against friction tending to hold the latch 48 in a present position. The door 14 or 24 is free to open. A spring 52 presses the catch 50 top the left against a stop 54.

Figure 5B:
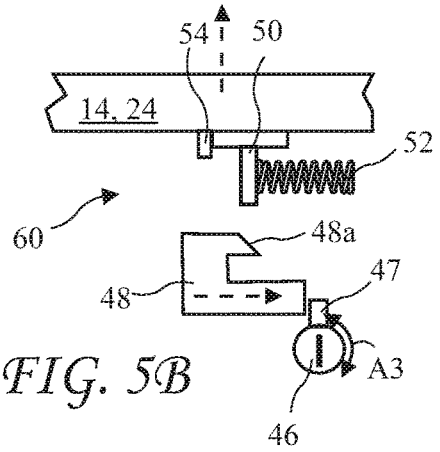
FIG. 5B shows a cross-sectional view of the built in manually lockable and key unlockable lock according to the present invention, taken along line 5-5 of FIG. 4, moved to a locked position with the door open.

A cross-sectional view of the lock 60 taken along line 5-5 of FIG. 4, unlocked, with the door 14 or 24 opened, is shown in FIG. 5B. The delivery personnel may now place a package inside the secure package receptacle 10. Before closing the door 14 or 24, the delivery personnel presses the latch 48 to the right.

Figure 5C:
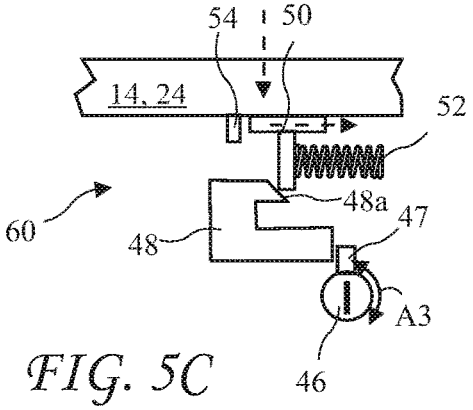
FIG. 5C shows a cross-sectional view of the built in manually lockable and key unlockable lock according to the present invention, taken along line 5-5 of FIG. 4, with the door partially closed.

A cross-sectional view of the lock 60 taken along line 5-5 of FIG. 4, with the door 14 or 24 closing, is shown in FIG. 5C. The catch 50 is urged by the latch 48 to slide to the right by engagement of a sloped nose 48*a* of latch 48 with the catch 50, allowing the door 14 or 24 to close. The friction resisting moving the latch 48 is sufficient to compress the spring 52 to prevent the catch 50 from urging the latch 48 to the left. The latch 48 may alternatively engage fixed left and right positions to prevent the catch 50 from urging the latch 48 to the left.

Figure 5D:
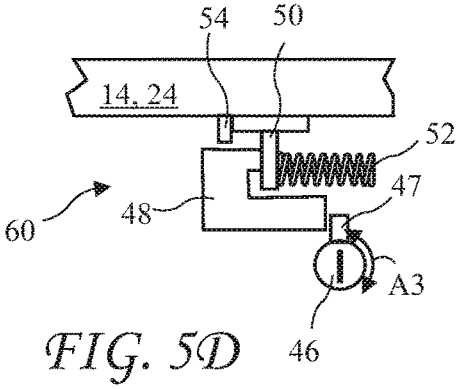
FIG. 5D shows a cross-sectional view of the built in manually lockable and key unlockable lock according to the present invention, taken along line 5-5 of FIG. 4, with the door closed and the lock engaged.

A cross-sectional view of the lock 60 taken along line 5-5 of FIG. 4, with the lock 60 locked with the door 14 or 24 closed, is shown in FIG. 5D.

Figure 5E:
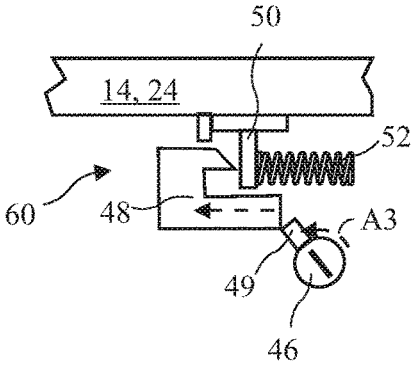
FIG. 5E shows a cross-sectional view of the built in manually lockable and key unlockable lock according to the present invention, taken along line 5-5 of FIG. 4, with the door closed and the lock disengaged by a key.

A cross-sectional view of the lock 60 taken along line 5-5 of FIG. 4, with the lock 60 unlocked with the door 14 or 24 closed, is shown in FIG. 5E. Turning the key 47 rotates a finger 49 against the latch 48 to slide the latch 48 to the left to disengage the latch 48 from the catch 50.

Figure 5F:
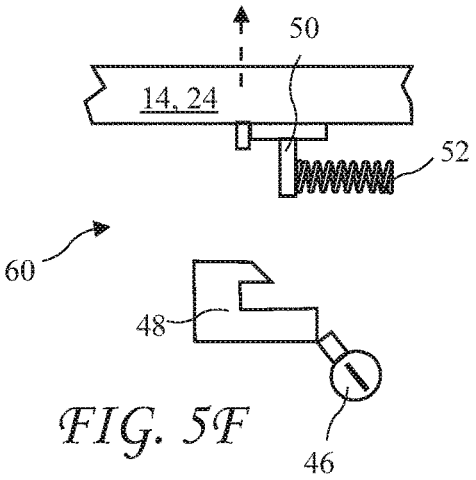
FIG. 5F shows a cross-sectional view of the built in manually lockable and key unlockable lock according to the present invention, taken along line 5-5 of FIG. 4, with the lock disengaged and door opened.

A cross-sectional view of the lock 60 taken along line 5-5 of FIG. 4, with the lock 60 unlocked with the door 14 or 24 open, is shown in FIG. 5F. The package may now be removed from the secure package receptacle 10.

While the invention herein disclosed has been described by means of specific embodiments and applications thereof, numerous modifications and variations could be made thereto by those skilled in the art without departing from the scope of the invention set forth in the claims.

We claim:

1. A secure package receptacle, comprising:

a seat portion;

a seat portion interior;

a seat portion door;

a seat portion lock securing the seat portion door in a closed position preventing removing packages from the seat portion interior, the seat portion lock unlockable to allow opening the seat portion door to place the packages into the seat portion interior and unlockable to allow opening the seat portion door to remove packages from the seat portion interior;

a backrest portion attached to and extending above a rear of the seat portion;

a backrest portion interior;

a backrest portion door; and a backrest portion lock securing the backrest portion door in a closed position preventing removing packages from the backrest portion interior, the backrest portion lock unlockable to allow opening the backrest portion door to place the packages into the backrest portion interior and unlockable to allow opening the backrest portion door to remove packages from the backrest portion interior.

2. The secure package receptacle of claim 1, wherein the seat portion lock and the backrest portion locks are padlocks.

3. The secure package receptacle of claim 1, wherein;

the seat portion lock and the backrest portion locks are fixed to the secure package receptacle; and the seat portion lock and the backrest portion locks are each a manually engageable mechanism engageable by delivery personnel after placing a package inside the seat portion interior or the backrest portion interior, and later disengaged using a key inserted through a lock face to retrieve the package.

4. The secure package receptacle of claim 3, wherein the seat portion lock and the backrest portion lock each comprise:

a right and left manually movable latch;

a catch engageable by the latch to lock the seat portion door or the backrest portion door;

a key operated finger engageable with the latch to disengage the latch from the catch.

5. The secure package receptacle of claim 4, wherein latch is held in a right and a left position by friction.

6. The secure package receptacle of claim 1, further including a weighted base attached to a bottom of the seat portion and the backrest portion.

7. The secure package receptacle of claim 1, further including an anchor passage on a rear surface.

8. The secure package receptacle of claim 1, wherein:

the secure package receptacle is between 24 and 36 inches wide;

the seat portion between 18 and 24 inches high and between 15 and 19 inches deep; and the backrest portion between 36 and 44 inches high and between 4 an 8 inches deep.

9. The secure package receptacle of claim 1, wherein:

the secure package receptacle is about 30 inches wide;

the seat portion about 20 inches high and about 17 inches deep; and the backrest portion about 40 inches high and about six inches deep.

10. The secure package receptacle of claim 1, wherein:

the seat portion door is a seat portion lid closing a top of the seat portion; and the backrest portion door is a backrest portion lid closing a top of the backrest portion.

11. The secure package receptacle, comprising:

a seat portion;

a seat portion interior;

a seat portion door;

a seat portion padlock securing the seat portion door in a closed position preventing removing packages from the seat portion interior, a seat portion padlock unlockable to allow opening the seat portion door to place the packages into the seat portion interior and unlockable to allow opening the seat portion door to remove packages from the seat portion interior;

a backrest portion attached to and extending above a rear of the seat portion;

a backrest portion interior;

a backrest portion door; and a backrest portion padlock securing the backrest portion door in a closed position preventing removing packages from the backrest portion interior, the backrest portion padlock unlockable to allow opening the backrest portion door to place the packages into the backrest portion interior and unlockable to allow opening the backrest portion door to remove packages from the backrest portion interior.

12. The secure package receptacle of claim 11, wherein:

the seat portion door is a seat portion lid closing a top of the seat portion; and the backrest portion door is a backrest portion lid closing a top of the backrest portion.

13. The secure package receptacle of claim 11, wherein:

the secure package receptacle is about 30 inches wide;

the seat portion about 20 inches high and about 17 inches deep; and the backrest portion about 40 inches high and about six inches deep.

14. A secure package receptacle, comprising:

a seat portion;

a seat portion interior;

a seat portion door;

a seat portion lock securing the seat portion door in a closed position preventing removing packages from the seat portion interior, the seat portion lock unlockable to allow opening the seat portion door to place the packages into the seat portion interior and unlockable to allow opening the seat portion door to remove packages from the seat portion interior;

a backrest portion attached to and extending above a rear of the seat portion;

a backrest portion interior;

a backrest portion door;

a backrest portion lock securing the backrest portion door in a closed position preventing removing packages from the backrest portion interior, the backrest portion lock unlockable to allow opening the backrest portion door to place the packages into the backrest portion interior and unlockable to allow opening the backrest portion door to remove packages from the backrest portion interior; and the seat portion lock and the backrest portion locks are fixed to the secure package receptacle, the seat portion lock and the backrest portion locks each comprising:

a right and left manually movable latch held in position by friction;

a catch engageable by the latch to lock the seat portion door or the backrest portion door; and a key operated finger engageable with the latch to disengage the latch from the catch.

15. The secure package receptacle of claim 14, wherein:

the seat portion door is a seat portion lid closing a top of the seat portion; and the backrest portion door is a backrest portion lid closing a top of the backrest portion.

16. The secure package receptacle of claim 14, wherein:

the secure package receptacle is about 30 inches wide;

the seat portion about 20 inches high and about 17 inches deep; and the backrest portion about 40 inches high and about six inches deep.

* * * * *